US007140821B2

(12) United States Patent
Sain

(10) Patent No.: US 7,140,821 B2
(45) Date of Patent: Nov. 28, 2006

(54) ROLL ON/ROLL OFF RAMP-DECK TRANSPORT PLATFORM

(75) Inventor: Bernard S. Sain, Jacksonville, FL (US)

(73) Assignee: ITL Technologies, Inc., Jacksonville, FL (US)

( * ) Notice: Subject to any disclaimer, the term of this patent is extended or adjusted under 35 U.S.C. 154(b) by 0 days.

(21) Appl. No.: 11/055,713

(22) Filed: Feb. 11, 2005

(65) Prior Publication Data

US 2005/0220543 A1 Oct. 6, 2005

Related U.S. Application Data

(63) Continuation-in-part of application No. 10/622,536, filed on Jul. 21, 2003, now Pat. No. 7,011,479.

(51) Int. Cl.
*B60P 7/06* (2006.01)

(52) U.S. Cl. ..... 410/46

(58) Field of Classification Search ..... 410/46, 410/52, 77
See application file for complete search history.

(56) References Cited

U.S. PATENT DOCUMENTS

| | | | | |
|---|---|---|---|---|
| 3,386,600 | A | 6/1968 | Betjemann | |
| 3,543,951 | A | 12/1970 | Marvin | |
| 3,620,388 | A * | 11/1971 | Mansson | 108/53.1 |
| 4,068,813 | A | 1/1978 | Chatwin et al. | |
| 4,151,925 | A | 5/1979 | Glassmeyer | |
| 4,221,515 | A | 9/1980 | Brown et al. | |
| 4,295,431 | A * | 10/1981 | Stavlo | 108/55.1 |
| 4,638,744 | A | 1/1987 | Clive-Smith | |
| 4,911,084 | A * | 3/1990 | Sato et al. | 108/57.17 |
| 4,986,705 | A | 1/1991 | Durkin | |
| 5,183,375 | A | 2/1993 | Fenton et al. | |
| 5,494,182 | A | 2/1996 | Clive-Smith | |
| 5,505,140 | A * | 4/1996 | Wittmann | 108/51.11 |
| 5,639,174 | A * | 6/1997 | Gonska | 403/103 |
| 5,644,992 | A * | 7/1997 | Clive-Smith | 108/55.1 |
| 5,720,228 | A * | 2/1998 | Clive-Smith | 108/55.1 |
| 5,755,472 | A * | 5/1998 | Clive-Smith | 294/67.1 |
| 5,810,186 | A | 9/1998 | Lam | |
| 5,842,821 | A | 12/1998 | Coslovi et al. | |
| 6,027,291 | A | 2/2000 | Sain et al. | |
| 6,390,743 | B1 | 5/2002 | Metternich | |
| 6,422,795 | B1 | 7/2002 | Holt et al. | |
| 6,460,227 | B1 | 10/2002 | Hove | |
| 6,513,442 | B1 * | 2/2003 | Miller et al. | 108/53.1 |
| 6,533,510 | B1 | 3/2003 | Sain | |
| 6,585,126 | B1 | 7/2003 | Grigsby, Sr. et al. | |
| 2004/0028496 | A1 | 2/2004 | Long et al. | |

(Continued)

OTHER PUBLICATIONS

"ISO Containers Collapsible Flat Rack 20'", http://www.cobracontainers.com/isocfr20_02.htm, dated Dec. 17, 2003.

(Continued)

*Primary Examiner*—H Gutman
(74) *Attorney, Agent, or Firm*—Foley & Lardner LLP

(57) ABSTRACT

A transport platform structure which is configured for vehicle roll on/roll off has a deck having a downwardly angled sloped portion at at least one end to produce an end-edge at an end of the platform. This end edge is dimensioned to have a vertical height configured to allow wheeled vehicles to roll from a surface on which the platform is disposed, against and up over the end-edge, and onto the deck without the interposition of structures movable with respect to the deck.

18 Claims, 9 Drawing Sheets

U.S. PATENT DOCUMENTS

2004/0067118 A1 4/2004 Kim

OTHER PUBLICATIONS

"Container design and types, Part 2", http://www.containerhandbuch.de/chb_e/stra/stra_ 03_01_01_02.h . . . , Section 3.10.1.2, dated Nov. 22, 2003.

"ISO Containers", Sea Box Inc., http://www.thomasregister.com/olc/58109661/, dated Nov. 22, 2003.

"M3 Flatrack, Container Roll-in/Out Platform (CROP)", http://www.summa.com/cropphotos.html, dated Nov. 22, 2003.

* cited by examiner

ROLL ON/ROLL OFF RAMP-DECK TRANSPORT PLATFORM

CROSS-REFERENCE TO RELATED APPLICATIONS

The present application is a continuation-in-part of a U.S. patent application Ser. No. 10/622,536 filed on Jul. 21, 2003 now U.S. Pat. No. 7,011,479 in the name of Bernard S. Sain, the entire contents of which are hereby incorporated by reference.

BACKGROUND OF THE INVENTION

1. Field of the Invention

The present invention relates generally to transport platforms for transporting cargo on container ships, and more specifically to open transport platforms which are configured for transporting oversized cargo such as vehicles/equipment and the like that cannot fit onto currently available transport platforms, and which are configured to permit vehicles to roll on and off without the need of additional structures such as ramps and the like.

2. Description of the Related Art

Open transport platforms, which have been used to transport vehicles or the like, have usually, due to their configuration and limited structural strength, been left to last during the loading process so that they can be placed on top of the uppermost containers on the deck of the container ship. That is to say, due to the limited ability of the platforms to bear large vertically acting loads such as those generated by the placement of a fully laden container on top thereof, the platforms have had to be disposed at the very tops of the container stacks. This, of course, severely limits both their utility and the number of platforms which can be carried on any one vessel.

A further drawback that open transport platforms suffer from is that, in order to have sufficient structural strength and durability, the platform and deck are relatively thick. Therefore, the ends of the platforms have a substantial vertical dimension and resemble a small vertically extending wall which juts up above the surface on which the platform is resting. The height of this end wall which can be about 24" for example, tends to be such that only wheels having large diameter can readily roll up and over the end of the platform, and then later roll off the end of the platform without noticeable impact. Accordingly, it is therefore usually necessary to either use cranes to lift the cargo into place, or provide ancillary pieces of equipment such a ramp or ramps in order to allow wheeled vehicles to smoothly roll on and off the end of the platform during unloading/unloading.

This, of course, reduces the utility of the platform in that additional/ancillary equipment which is in itself heavy must either be carried with the platform, adding to its dead weight and complexity, or alternatively some means for moving the ancillary equipment about, such as fork lift of the like, must also be provided at both the site where the vehicles are loaded and the site wherein the vehicles are unloaded. In the case of a military operation (for example), it is often such that conditions are less than favorable and in the case of war or the like, the availability of ramps and fork lifts cannot be guaranteed and the daunting task of manually moving such heavy pieces of equipment from platform to platform may be too much should sufficient man-power (for example) not be available.

In addition to the above shortcoming, open transport platforms have suffered from the drawback that the holds of modern container ships are usually constructed to receive predetermined sized containers which are usually 40'×8' long ISO (International Standards Organization) containers. These holds have bulkheads at each end which extend laterally from port to starboard. These bulkheads are each provided with vertically extending cell guides that are sized to permit the 40'×8' ISO sized containers to be slid down between T-shaped guide members which define the cell guides, and thus be securely held at each end thereby.

With this construction, the containers can be secured against both rolling and pitching of the container ship. That is to say, disposition of 40' containers between the bulkheads, which are spaced by about 40', prevents fore-aft movement of the containers due to pitching of the vessel during transit, while the engagement of the ends of the containers with the T-guides prevents lateral movement (port/starboard movement) due to rolling of the vessel. It should be noted that it is also possible with this type of arrangement to dispose two 20' ISO containers in an end-to-end arrangement, between the bulkheads.

After a hold is filled with the above-mentioned types of ISO containers, a hatch is placed over the top to close the hold. Containers are then stacked on top of the hatches.

However, it has been extremely difficult, if not impossible, to dispose anything but the 40'×8' ISO containers in the holds, and attempts to dispose transport platforms below deck have not met with success. Thus, storage in such holds has been limited to the above mentioned 40'×8' ISO containers which are dimensioned to fit in the cell guides. This means that off-sized containers or platforms, which are either wider or narrower than the width of the cell guides, cannot be secured below deck in the holds and are relegated to possible disposition above deck.

As will be readily understood, in many instances it is highly desirable to store cargo which is being carried on an open transport platform, below deck so as to enclose same and thus limit the amount of exposure to the elements during shipping.

SUMMARY OF THE INVENTION

A first aspect of the invention resides in a transport platform structure configured for vehicle roll on/roll off which comprises a deck which has a downwardly angled sloped portion at at least one end to produce an end-edge at an end of the platform which has a vertical height sufficient to allow wheeled vehicles to roll from a surface on which the platform is disposed, against and up over the end-edge, and onto the deck without the interposition of structures movable with respect to the deck.

It is within the scope of this aspect of the invention to have a second downwardly angled and sloped portion at a second end of the platform to produce a second end-edge at the second end of the platform which also a vertical height that allows vehicles to roll from a surface on which the platform is disposed, against and up over the second end-edge, and onto the deck without the interposition of structures movable with respect to the deck.

In at least one embodiment, the deck has an essentially horizontal portion between the sloping deck portions. The platforms further comprises pairs of telescopic pillars provided at each end. Each pair of these telescopic pillars is connected at their upper ends by upper cross-members which are accordingly movable in response to telescopic extension/retraction of the pillars. In certain embodiments, the pillar pairs are spaced to facilitate engagement with a crane spreader such as a 40' standard crane spreader which is used to engage and lift 40' long ISO containers.

The outboard edges of the upper cross-members and end-edges of the platform are respectively provided with structures in which slots, which have a predetermined width and spacing, are formed, The slots which are associated with the upper-cross members are aligned with the slots associated with the end edges. These slots are configured to slidably receive guide members that are provided on container ship hold bulkheads.

The platforms which are provided with the above-mentioned slots can have a width which is greater than a distance between the guide members provided on the container ship bulkheads. By way of example, the width can be 10'–12' or 14'. The slots in the upper cross-members and the slots in the end-members are respectively spaced in a predetermined relationship with a width of the platform and a distance between the vertically extending guide members that are disposed on the bulkheads.

A second aspect of the invention resides in a transport platform comprising: an essentially flat deck portion; and first and second sloping end deck portions which are respectively contiguous with the flat platform portion and which respectively lead to first and second ends of the platform to define first and second platform ends that have a thickness (viz., a vertical height) less than the thickness of the platform at the flat deck portion and which first and second platform ends are configured to facilitate wheeled vehicles being driven directly onto the platform structure from a surface on which the platform is resting during loading or the like.

This transport platform has pillars provided on either side and at both ends of the platform. In one embodiment the pillars are pivotally connected to the platform to enable them to be pivoted down onto a deck portion of the platform. In another embodiment the pillars are adjustable in length and pairs thereof have an upper cross-member interconnecting the upper ends thereof.

In a further embodiment, the platform is provided with end-members that are connected with the platform and which extend parallel with the upper cross-members. The upper cross-members and the end members are provided with openings configured to enable connection of the transport platform to an adjacent structure. These openings are configured to enable connection with connection rails that are configured to connect the transport platform to one or more adjacent containers.

In accordance with one embodiment, the openings in the upper cross-members and the end-members comprise openings in twist lock castings which are connected with the upper cross-members to allow for twist lock devices to interconnect the upper and lower cross members with the connection rails.

In accordance with another embodiment, the openings in the upper cross-members and the end-members comprise spaced vertically extending slots that are configured to engage vertically extending guide members which form part of a container ship hold bulkhead. These slots, at least in this embodiment, are spaced so that a number of platforms can be disposed side-by-side across the bulkhead of the container ship hold in manner wherein the number of spaces between the guide members is different from the number of platforms.

A further embodiment is such that the upper cross-members and end-members in which the slots are formed are adjustably connected to a frame of the platform so as to be laterally adjustable within a predetermined limit with respect to the platform proper.

BRIEF DESCRIPTION OF THE DRAWINGS

The various aspects and advantages of the embodiment of the present invention will become more clearly appreciated as a description thereof is given with reference to the appended drawings in which.

DETAILED DESCRIPTION OF THE EXEMPLARY EMBODIMENTS

Figure 1:
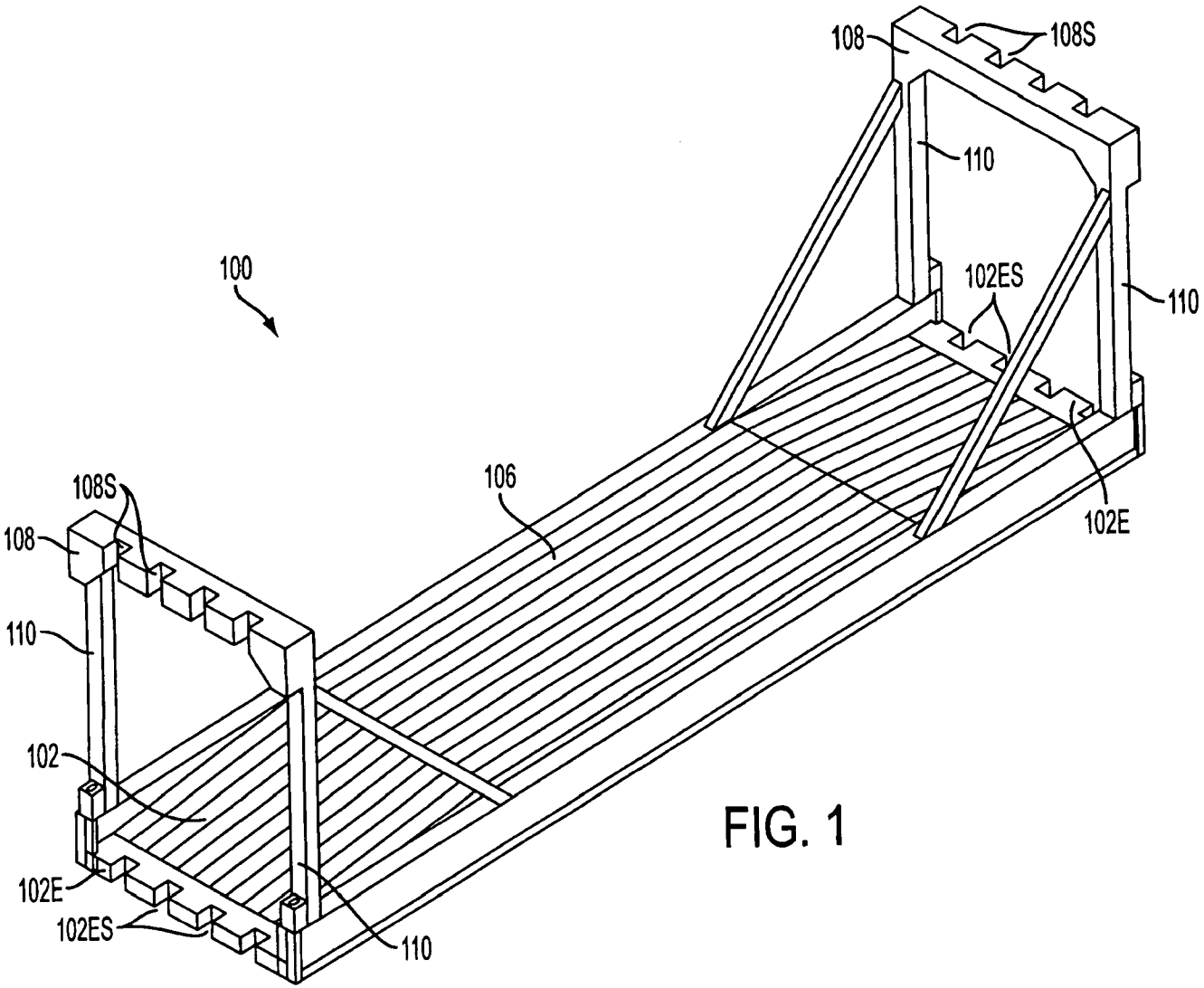
FIG. 1 is perspective view of an embodiment of an easy roll on/roll off transport platform which is configured for storage below deck in the cargo hold of a container ship, and which is provided with a easy roll on/roll off sloped deck structure.

FIG. 1 is a perspective view of an easy roll on/roll off ramp-deck transport platform 100 according to a first embodiment of the invention. This platform 100 is constructed so that both of the two opposed end portions 102 of the platform 100 are sloped and lead from an essentially flat, horizontal central portion 106 to each end of the platform. This sloping deck construction reduces the vertical height of the edges 102E of the platform from "A" to "a" in the manner depicted in FIG. 2.

Figure 2:
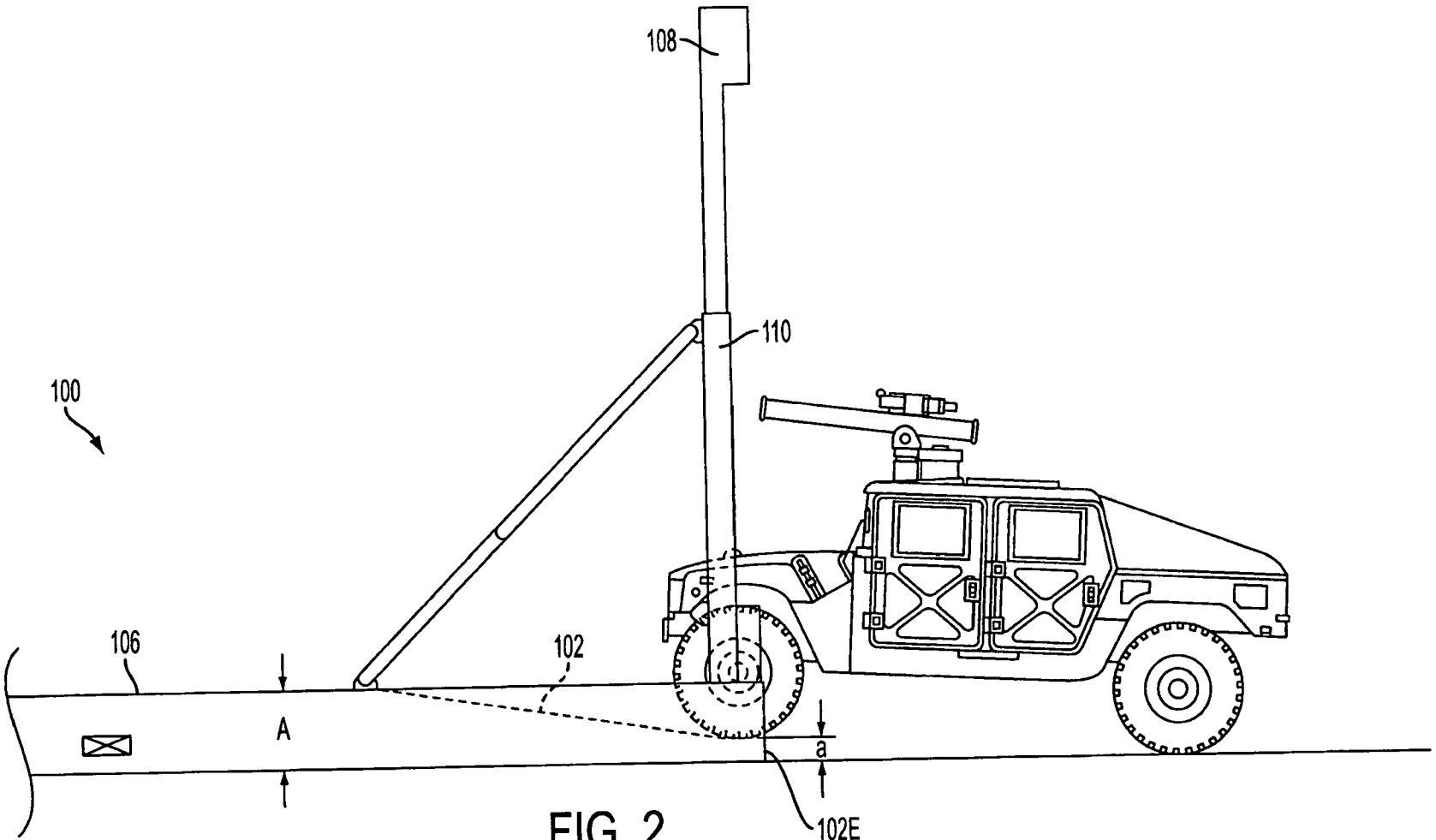
FIG. 2 is a side view showing a wheeled military vehicle moving from a surface on which the platform is placed, up over the step defined at the end of the platform by the sloping deck portions.
Figure 3:
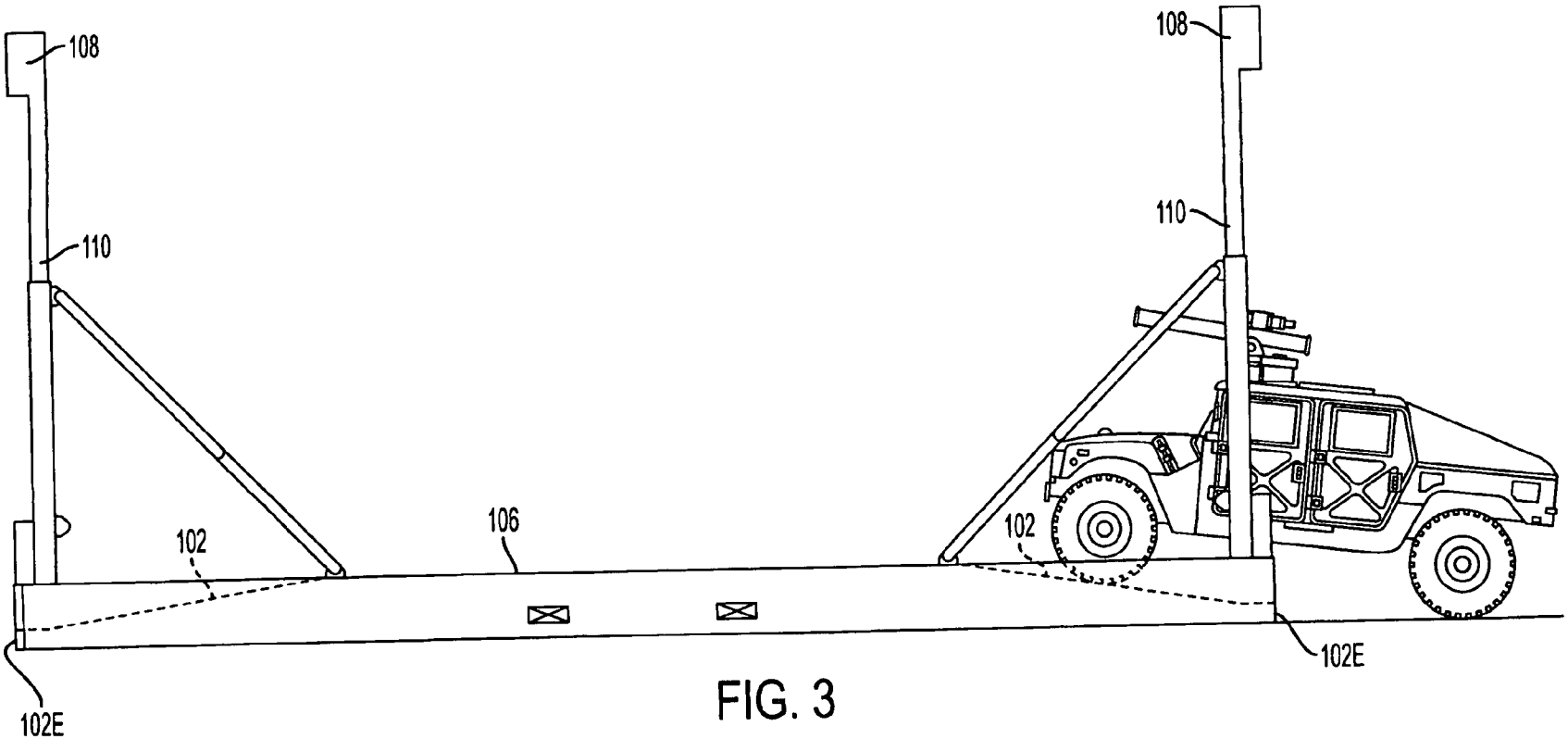
FIG. 3 is a side view similar to that shown in FIG. 2 wherein the vehicle is shown having moved further onto the deck of the platform.
Figure 4:
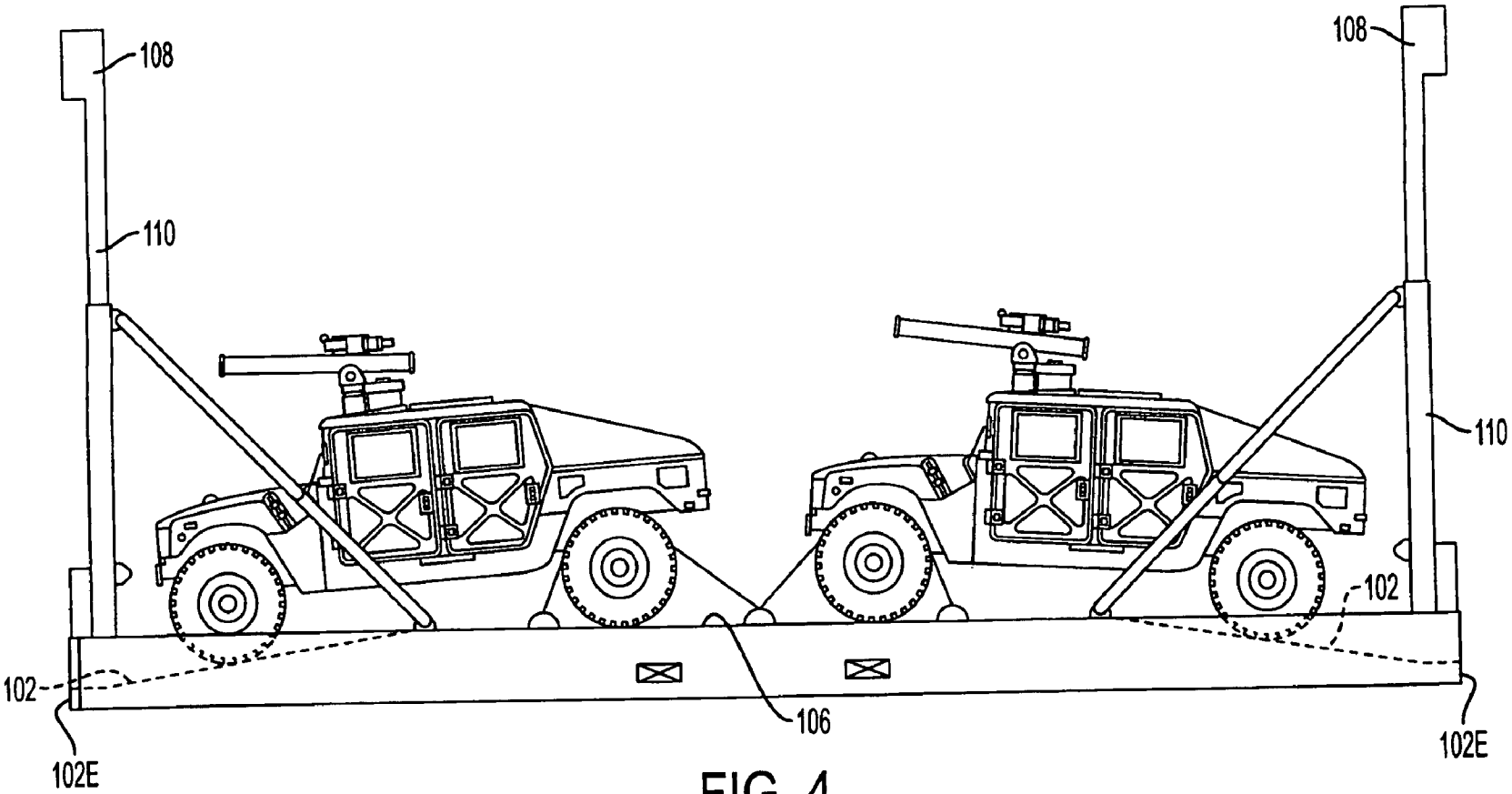
FIG. 4 is a side view showing examples of two military vehicles (merely by way of example) disposed on the deck of the platform.

This reduction in vertical height (A→a), wherein "A", by way of example only, can be about 24" and "a" can be about 6", renders the edges 102E of the platform 100 readily traversable by wheeled vehicles in the manner illustrated in FIG. 2 Hence, with no moving parts or the need for additional structures such as ramps and the like, medium sized wheeled/track vehicles such as SUV (Sports Utility Vehicles) and even smaller vehicles (wheeled or tracked vehicles) are able to drive up and onto the platform with relative ease. The absence of any moving part obviates any weight penalties due to heavy structures that need to be operated/moved.

This embodiment is configured for below deck storage on a container ship. To this end, the edges 102E and the cross beams 108 which is supported on the vertically extending pillars 110, are formed with a series of spaced slots 102ES and 108S. These slots 102ES and 108S are sized and spaced so as to receive T-guide members (T/G) which are secured to the bulkheads of cargo ship holds.

Figure 5:
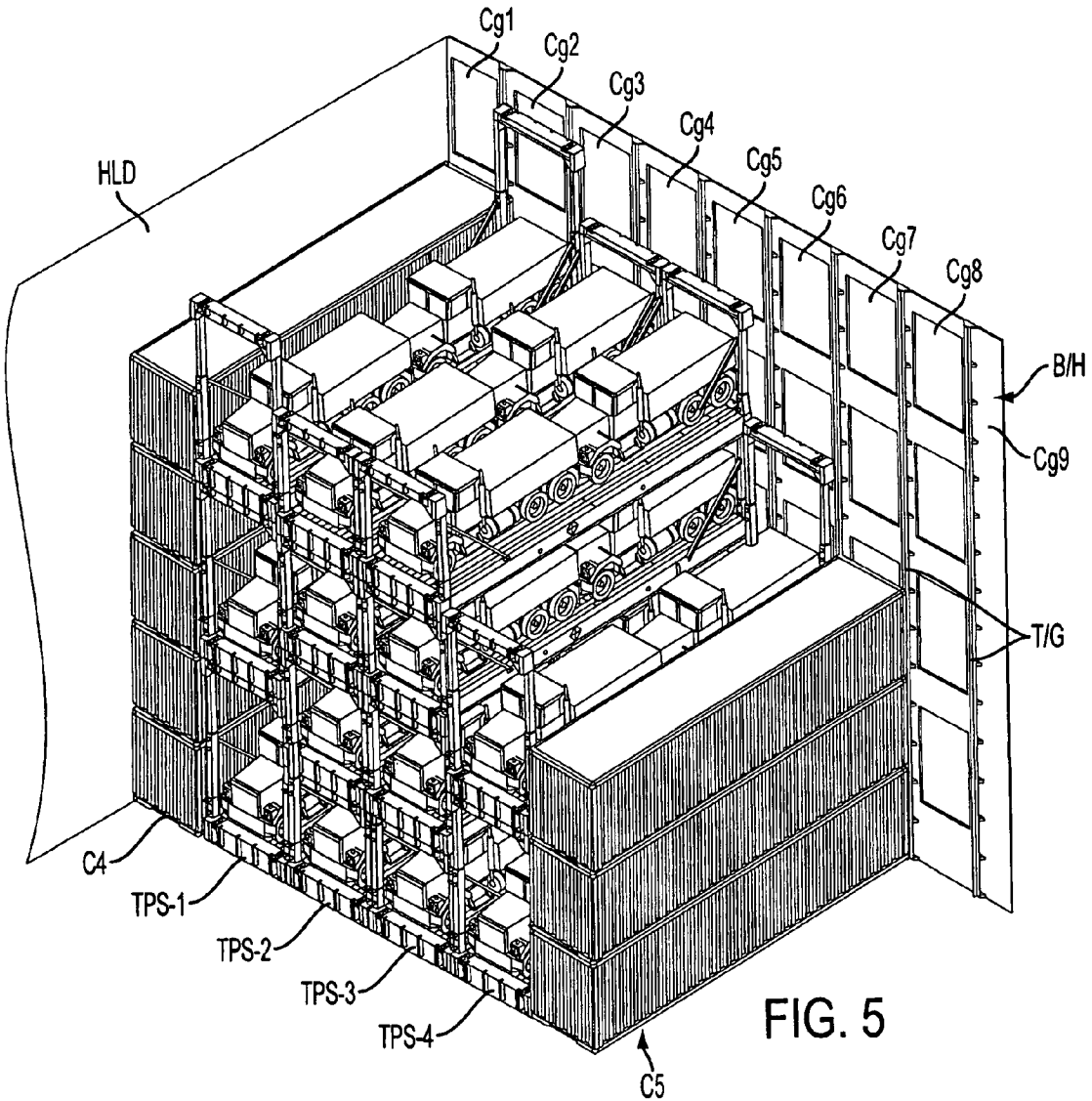
FIG. 5 is a perspective view showing the manner in which shipping platforms of the type to which the embodiments of the invention are directed, can be slid down into a hold of the container ship.

By way of example, FIG. 5 depicts a situation wherein transport platforms of the nature disclosed in the above mentioned patent application U.S. patent application Ser. No. 10/622,536, are disposed along with 40'×8' ISO containers in a hold HLD of a container ship. As shown, the hold HLD has a bulkhead B/H having the T-guides (T/G) welded/bolted thereto at intervals which are selected to permit 8' wide ISO containers to be slide therebetween and prevented from moving sideways (laterally) across the hold, in response to rolling of the container ship during transit. Although not show, the other end of the hold has another bulkhead which is similarly equipped with T-guides. This second bulkhead is spaced in the fore-aft direction of the ship such that two 40'×8' ISO containers can be disposed end to end. Of course, the container ship is constructed so that these type of holds extend along almost the entire length of the vessel so as to maximize the cargo carrying capacity of the same.

The width of the holds in the parallel mid-body of the ships remains constant. However, in the bow and aft sections of the vessel, the tapering configuration of the ships hull demands that the widths of the holds reduce as they approach the ends of the vessel.

FIG. 5, in this instance is such as to show a stack of 40' ISO containers C4 (note that two 20' containers can be placed end to end in place of a 40' container); four stacks of transport platforms TPS (TPS-1 . . . TPS-4) according to the second embodiment of the invention; and a further stack of ISO containers C5, which are disposed in a hold HLD in the illustrated manner. The bulkhead B/H is shown as having a plurality of vertically extending T-guide members T/G rigidly connected thereto. Cell guides Cg1, Cg2, Cg3 . . . Cgn in which ISO containers can be slidably disposed, are defined between each adjacent two of the T-guide members T/G. Empty cell guides Cg8, Cg9 are shown at a right hand side of the figure.

The slots 102ES and 108S are aligned with one another and spaced in a predetermined relationship with the distance between the T-guides T/G. The width of the slots is selected to allow for ship-to-ship variations in the dimensions of the T-guide members T/G and are such as to leave a small amount of clearance that is sufficient to avoid interference between the T-guide members T/G and the sides of the slots 406 while avoiding any significant lateral movement that may be problematical during transit.

In more detail, the arrangement illustrated in FIG. 5 is such that a first stack of ISO containers C4 are arranged so that the ends are received in a first set of cell guides (one at each end of the stack). Beside this first stack of containers C4, is a first stack of transport platforms TPS-1. As will be appreciated, each of the platforms in this stack TPS-1 is wider than the adjacent stack of ISO containers.

To secure the ends of the first stack of platforms TPS-1, one of the T-guides T/G is received (in this illustration) in the end most set of aligned slots provided at the end of the platform TPS-1. This allows a portion of the platform TPS-1 (which is, as noted above, wider than the cell guides) to extend from the second cell guide Cg2 into the third cell guide Cg3. The next stack of platforms TPS-2 is disposed so as to span the third and fourth cell guides (Cg3, Cg4) and to have a T-guide C/G received in a second from the end set of vertically aligned set of slots. The following stack of platforms TPS-3 is disposed so as to span the fourth and fifth cell guides (Cg4, Cg5) and to have a T-guide C/G received in a third from the end set of vertically aligned set of slots. The next, and final stack of platforms TPS-4, is disposed so as to span the fifth and sixth cell guides Cg5, Cg6 and to have a T-guide T/G received in the fourth and last set of vertically aligned set of slots.

The width of the platforms in the stacks TPS-1 . . . TPS-4 and the spacing of the vertically extending slots 406, 416 induces the situation wherein the sixth cell guide Cg6 is filled and the situation is established wherein the edges of the platforms in the stack TPS-4 slides along an inboard edge of the T-guide T/G which separates the sixth and seventh cell guides. This, of course, fills the cell guides Cg2–Cg6 and allows the stack of ISO containers C5 to be slid down into the next (seventh) cell guide Cg7 as if nothing but stacks of ISO containers had been loaded into the hold.

It will be noted that the transport platforms which are illustrated in FIG. 5 are not shown has having the sloping end deck construction which is used in the embodiment of the invention which is illustrated in FIGS. 1–4 and demonstrate the relatively high step which is presented to wheeled vehicles in the event that a ramp or the like is not provided to facilitate loading and unloading of the platforms.

Figure 6:
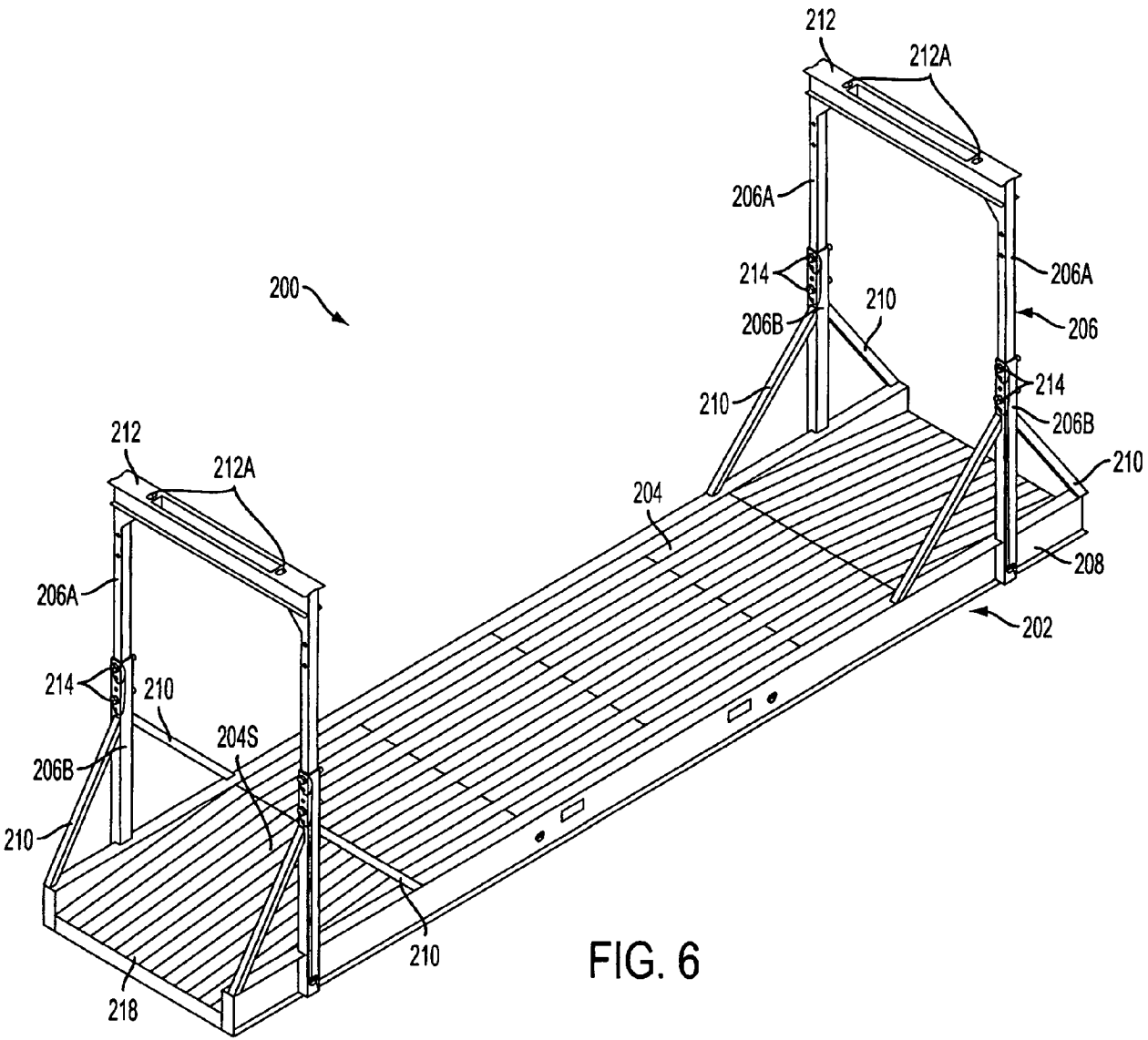
FIG. 6 is a perspective view of a second embodiment of the invention which is configured for above deck use.
Figure 7:
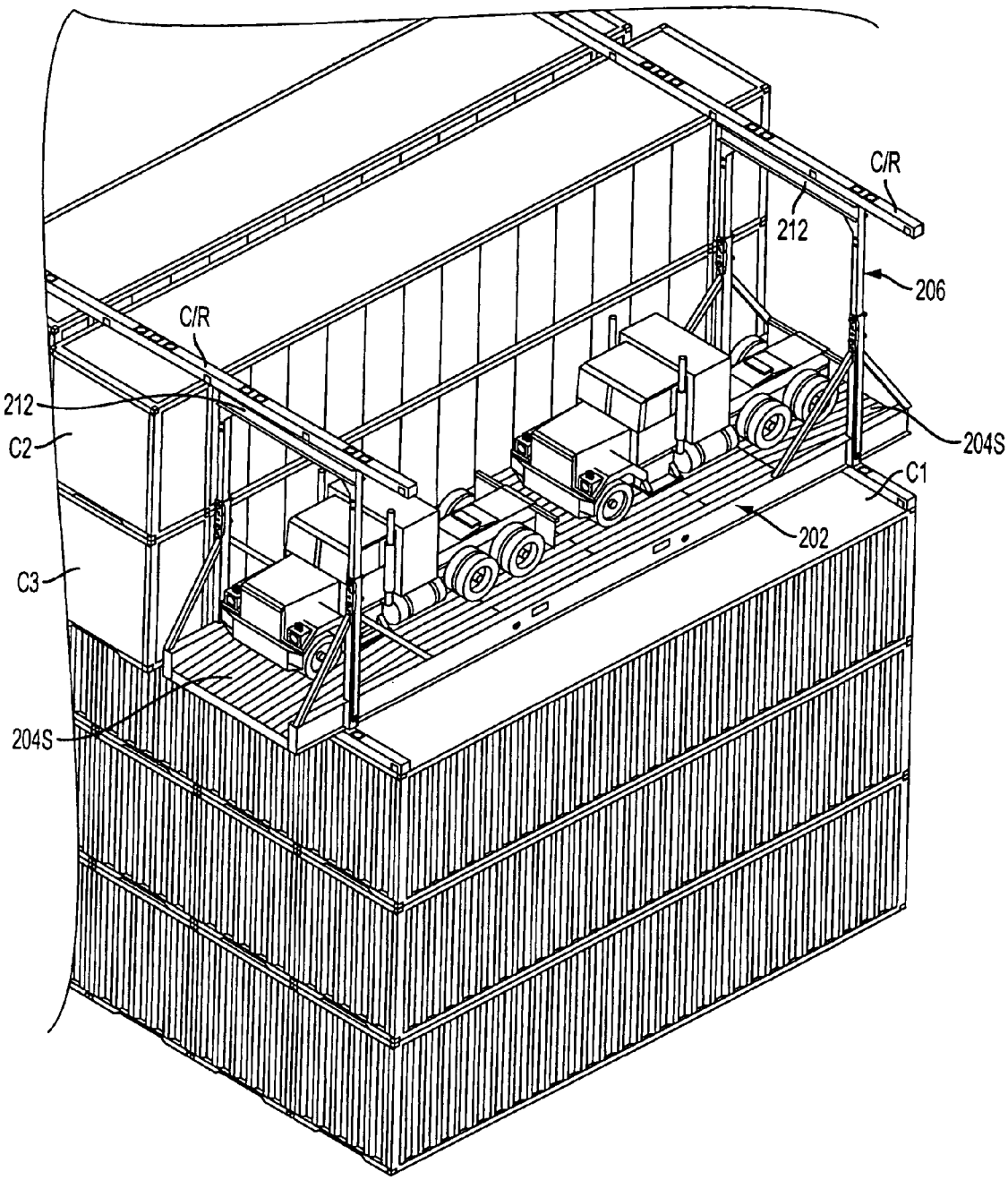
FIG. 7 is a perspective view of the second embodiment of the invention disposed above deck and secured in place using load sharing connection rails.

FIG. 6 depicts a second embodiment of the invention. The transport platform 200 in accordance with this second embodiment is not adapted for disposition below deck and can be used above deck in the manner depicted in FIG. 7. This embodiment is basically similar to that shown in FIG. 1 and differs in that the masts are disposed further inboard of the ends of the platform than in the case of the FIG. 1 embodiment. This embodiment is also configured for use with connection rails C/R, which not only interconnect the transport platforms with adjacent containers but also enable load to be shared in a manner wherein the pillars or masts 206 can be spared the need to support all of the weight of a container or other transport platform which is disposed directly above the same.

More specifically, this embodiment is such that the basic platform 200 comprises an I-beam frame or chassis 202 with a planked floor 204 supported thereon. The planking can be metal, wood or any other suitable material. Pairs of pillars or masts 206 are arranged inboard each end of the platform chassis 202 and essentially mid-way between the end of the platform and the point where the deck 204 transitions between a flat surface and the sloping floor sections 204S.

The lower ends of these pillars 206 are secured to the outer sides of side I-beams 208 which form part of the I-beam chassis 202. These pillars 106 are braced in position by angled reinforcing members 210 which, in this embodiment, extend at angles between the pillars and the upper edges of the side I-beams 208 and which are securely welded in position.

Each of the pillars 206 are telescopic so that the height of each of the I-beam upper cross-members 212, which interconnect the upper ends of each end of the telescopic portion 106A with each of the base members 206B of the pillars 206, can be adjusted and locked in a selected one of a predetermined number of positions. These positions are selected with respect to the different heights of the different sized/types of containers beside which this embodiments of the transport platforms 200 can be disposed.

In the illustrated embodiment, the interlocking of the telescopic members 206A with the base member 206B of the pillars 206 is achieved using locking pins 214 and a series of apertures formed in each of the stationary base and telescopic upper ends 206B, 206A of the pillars. Once the upper ends 206A are in the required relative positional relationship with respect the base members 206B, a locking pin 214 can be inserted through each set of mating apertures to lock the pillars in the desired condition. The locking pins 214 may take the form of bolts so that a nut or nuts can be placed on the ends to ensure that vibration and the like does not induce any undesirable movement or disengagement of the pins. Alternatively, the pins 214 may be smooth and can be provided with some other suitable form of securing arrangement such as cross pins or the like to prevent unwanted movement during shipping.

As noted above, the telescopic pillars 206 can be set to a plurality of different heights. These heights are selected to correspond to the heights of differently sized containers and further set to a fully collapsed minimum height position which facilitates storage when not in actual use.

The upper cross-members 212 are formed with apertures 212A into which twist locks associated with the connection rails or beams C/R, can be disposed and engaged with the cross-members when the connection rails C/R are placed in position in the manner illustrated in FIGS. 1 and 2. These connection rails C/R are interconnected to the tops and bottoms of container and platforms through twistlock devices. The interposition of these connection rails C/R between layers in the container enables, as noted above, vertical load to be shared between the containers and the masts 600. These rails C/R also laterally interconnect the containers and platforms so as to create a unit of interconnected elements which interlocks the stacks together and prevents lateral movement of any one container with respect to an adjacent container/platform.

Figure 8:
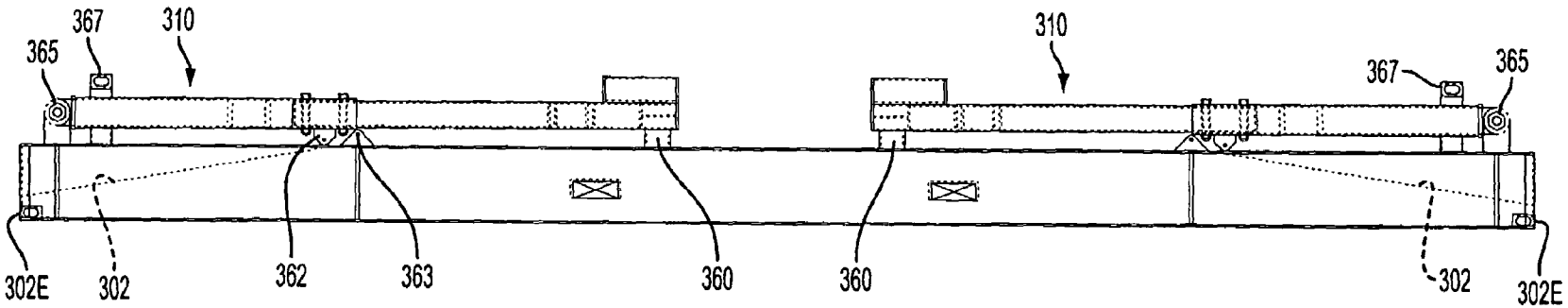
FIG. 8 is a side elevation of a further embodiment of the transport platform having pivotal, telescopic pillar members.
Figure 9:
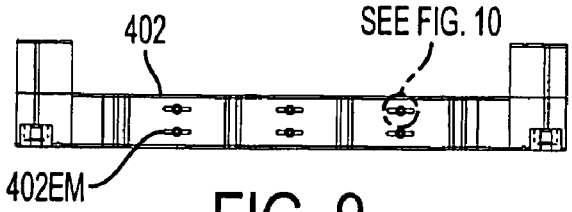
FIG. 9 is a front elevation of an easy roll on/roll off transport platform wherein the slotted member forming the leading edge of the platform is laterally adjustable.
Figure 10:
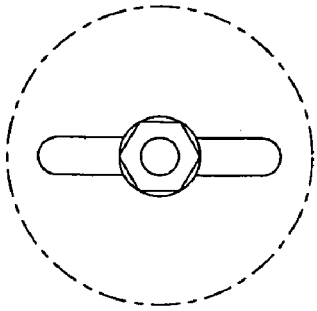
FIG. 10 is an enlargement of a slot/bolt arrangement which enables the lateral adjustment of the slotted member.
Figure 11:
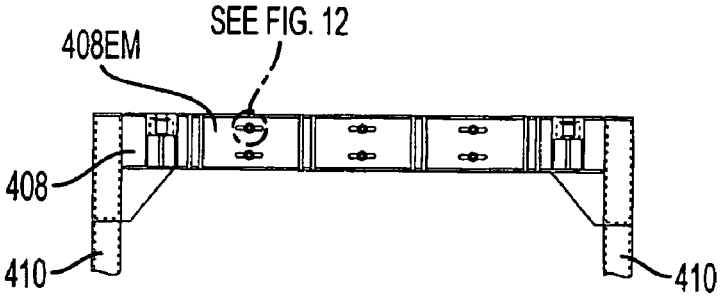
FIG. 11 is a front elevation of a slotted cross member which is supported at the upper ends of the vertical pillars and which is configured to be laterally adjustable.
Figure 12:
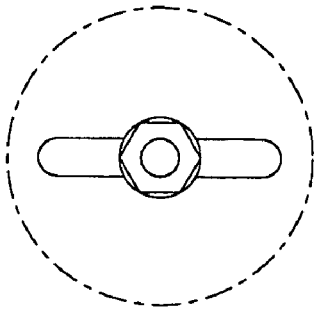
FIG. 12 is an enlargement of a slot/bolt arrangement which enables the lateral adjustment of the slotted cross member shown in FIG. 11.

FIG. 8 is a side elevation showing a third embodiment of the present invention. This third embodiment is provided with sloping deck portions 302, and pivotal masts 310. As shown, in this third embodiment 300, the masts 310 are arranged to be pivotal at a location near their bases so as to allow them to fold down onto the deck of the platform in the manner shown in FIG. 8.

Support blocks 360 are provided on either the deck or the masts to engage the mast when it is in a folded position and extends essentially parallel to the top of the deck. Further, the deck and mast are provided with projections 362, 363 which in this embodiment are essentially triangular in shape. These projections 362, 362 are use to connect the ends of an angled braces (not shown in this figure) which establish a reinforcing triangulation. In this third embodiment, these angle braces maintain the masts upright during use.

These projections 363 can also be used as connection sites for tie-down cables/chains if so required.

The hinges 365 in this third embodiment are constructed so that the pivot shaft is a bolt which can be removed to allow the mast be disconnected/replaced or the like.

As shown in FIG. 19, further outwardly extending projections 367 are provided on the masts. These projections 367 are slotted and are arranged so that the slots align with one of the slots in the end member. Alternatively, this projection can take the form of a cross-member which interconnects the lower ends of the masts and thus adds rigidity to the structure. This member, if provided, is formed with a plurality of slots which correspond to and are aligned with those formed in the end of the platform.

FIGS. 9–12 show a fourth embodiment of the invention which is configured for below deck storage. In this embodiment, the end members 402EM, 408EM are formed with the slots 102S, 108S and are connected to the end of the sloping deck portions 402 and the cross beams which interconnect the upper ends of the pillars in a manner which allows for a limited amount of lateral movement of the end members 402EM, 408EM with respect to the platform proper.

This can be achieved a plurality of large diameter bolts (0.5–1.0 inch by way of example) and a corresponding number of horizontally extending elongate bolt holes (slots) 402S. The length of the horizontally extending elongate bolt hole 402S allows the end members 402EM, 408EM to be loosened via the loosening of nuts 402N and slid sideways with respect to the platform proper by about the length of the elongate holes 402S minus the diameter of the bolts. Merely by way of example, the amount of adjustment provided by the elongate holes is about 4 inches. This adjustability allows for the position of the platform to be adjusted with respect to the hold HLD and can be useful for locating a platform with the appropriate clearance with respect to the side of a hold or the like and avoiding any potential problematical interferences which might occur on a ship-to-ship or even hold-to-hold basis and hinder the loading and stacking process.

While the invention has been disclosed with reference to only a limited number of embodiments, the various modifications and variations which can be made without departing from the scope of the invention, which is limited only by the appended claims, will be self-evident to those skilled in the art of container construction and shipping.

What is claimed is:

1. A transport platform configured to permit a vehicle to roll on and off, comprising:

a deck which has a downwardly angled sloped portion at at least one end to produce an end-edge at an end of the deck, the end edge being dimensioned to have a vertical height configured to allow wheeled vehicles to roll from a surface on which the platform is disposed, against and up over the end-edge, and onto the deck without the interposition of structures movable with respect to the deck; and pairs of telescopic pillars provided at or proximate each end, each pair of telescopic pillars being connected at their upper ends by upper cross-members which are movable in response to telescopic movement of the pillars.

2. A transport platform as set forth in claim 1, further comprising a second downwardly angled and sloped portion at a second end of the deck to produce a second end-edge at the second end of the platform which a vertical height that allows vehicles to roll from a surface on which the platform is disposed, against and up over the second end-edge, and onto the deck without the interposition of structures movable with respect to the deck.

3. A transport platform as set forth in claim 2, wherein the deck has an essentially horizontal portion between the sloping deck portions.

4. A transport platform as set forth in claim 1, wherein the pairs of telescopic pillars are spaced by a predetermined distance selected to facilitate engagement with a crane spreader.

5. A transport platform as set forth in claim 1, wherein the outboard edges of the upper cross-members and end-edges of the deck are respectively provided with structures in which slots having a predetermined width and spacing are formed, the slots associated with the upper-cross members being aligned with the slots associated with the end edges.

6. A transport platform as set forth in claim 5, wherein the slots in the structures provided on the upper cross-members and the slots in the structures provided on the end-edges are configured to slidably receive guide members that are provided on container ship hold bulkheads.

7. A transport platform as set forth in claim 6, wherein the platform has a width and a length and wherein the width of the platform is greater than a distance between the guide members provided on the container ship bulkheads.

8. A transport platform as set forth in claim 7, wherein the width of the platform is about 10–14 feet.

9. A transport platform as set forth in claim 6, wherein the slots in the upper cross-members and the slots in the end-edges are respectively spaced in a predetermined relationship with a width of the platform and a distance between the vertically extending guide members which are disposed on the bulkheads.

10. A transport platform comprising:

an essentially flat deck portion:

first and second sloping end deck portions which are respectively contiguous with the flat deck portion and which respectively lead to first and second ends of the platform to define first and second deck ends that have a thickness less than the thickness of the platform at the flat deck portion, said first and second deck ends being configured to enable a wheeled vehicle to be driven directly onto the platform from a surface on which the platform is disposed; and pillars provided on either side and at or proximate both ends of the platform.

11. A transport platform as set forth in claim 10, wherein the pillars are pivotally connected to the platform to enable the pillars to be pivoted down onto a deck portion of the platform.

12. A transport platform as set forth in claim 11, wherein the pillars are adjustable length pillars and are arranged in pairs which have an upper cross-member interconnecting the upper ends thereof and which are spaced so as to facilitate engagement with a crane spreader.

13. A transport platform as set forth in claim 10, wherein the platform is provided with end-members that are connected with the platform and which extend parallel with the upper cross-members, the upper cross-members and the end members being provided with openings configured to enable connection of the transport platform to an adjacent structure.

14. A transport platform as set forth in claim 13, wherein the openings are configured to enable connection with connection rails that are configured to connect the transport platform to one or more adjacent containers.

15. A transport platform as set forth in claim 14, wherein the openings in the upper cross-members and the end-members comprise openings in twist lock castings which are connected with the upper cross-members to allow for twist lock devices to interconnect the upper and lower cross members with the connection rails.

16. A transport platform as set forth in claim 13, wherein the openings in the upper cross-members and the end-members comprise spaced vertically extending slots that are configured to engage vertically extending guide members which form part of a container ship hold bulkhead.

17. A transport platform as set forth in claim 13, wherein the upper cross-members and end-members are adjustably connected to a frame of the platform so as to be laterally adjustable within a predetermined limit with respect to the frame of the platform.

18. A transport platform as set forth in claim 17, wherein the slots in the end-members and the cross-members are spaced so that a number of platforms can be disposed side-by-side across the bulkhead of the container ship hold in manner wherein the number of spaces between the guide members is different from the number of platforms.

* * * * *